United States Patent [19]

Zaccheroni

[11] 4,394,924

[45] Jul. 26, 1983

[54] PROCESS FOR MAKING GABIONS PROVIDED WITH INNER PARTITIONS

[75] Inventor: Giulio Zaccheroni, Bologna, Italy

[73] Assignee: S.p.A. Officine Maccaferri gia Raffaele Maccaferri & Figli, Bologna, Italy

[21] Appl. No.: 262,881

[22] Filed: May 12, 1981

[30] Foreign Application Priority Data

Jun. 10, 1980 [IT] Italy ..... 67902-A/80

[51] Int. Cl.[3] ..... B65D 6/08; B65D 25/04

[52] U.S. Cl. ..... 220/19; 140/107; 220/22; 405/16; 405/32

[58] Field of Search ..... 140/107, 109, 24, 111, 140/3 R; 220/19, 22; 245/7, 10; 405/15, 16, 32; 43/105

[56] References Cited

U.S. PATENT DOCUMENTS 889,815 6/1908 Schmid ..... 140/24

3,722,554 3/1973 Vanderfaeille ..... 140/24

FOREIGN PATENT DOCUMENTS 845863 8/1960 United Kingdom ..... 405/32

*Primary Examiner*--Francis S. Husar

*Assistant Examiner*—Linda McLaughin

*Attorney, Agent, or Firm*—Sughrue, Mion, Zinn, Macpeack and Seas

[57] ABSTRACT

According to the invention, the articulated connection of a "diaphragm" to the "base panel" of a gabion is carried out by bending divergent portions of pairs of wires twisted together along common sides of the diaphragm's hexagonal meshes in the marginal row of these meshes which is to be connected to the base panel so as to dispose each of these portions within the hexagon of which is constitutes a side so as to be substantially parallel to that portion of the same wire which extends from the other end of the common side of two adjacent hexagonal meshes which the two wires are twisted together to form; the double-hooked structure which is thus obtained is then anchored to meshes of that part of the base panel intended to form the bottom of the gabion, these meshes being in the same row extending between two parallel edges of the panel itself.

3 Claims, 5 Drawing Figures

PROCESS FOR MAKING GABIONS PROVIDED WITH INNER PARTITIONS

THE TECHNICAL FIELD TO WHICH THE INVENTION RELATES

The present invention relates to the art of making so-called "box gabions", that is, containers made from metal-wire netting having a multiple-twist hexagonal mesh, in the form of rectangular prisms sub-divided into cells by the insertion of diaphragms made of the same type netting, and intended for the lay-out of water courses, the protection and support of roads, railways, airports and buildings, for coastal protection, etc.

More particularly, the present invention relates to a process for the articulated connection of at least one diaphragm to the base panel of a rectangular-prism-type gabion formed from metal-wire netting having a multiple-twist hexagonal mesh, the gabion being subdivided into cells by diaphragms made from the same type of netting as that forming the gabion and attached directly to the base panel in such a manner that they can be laid on the panel itself.

BACKGROUND ART

According to the known art, diaphragms were fixed to the base-panel by means of helical seaming with an iron wire effected by a purpose-made device arranged in the production line, the device being able to assemble cut pieces of multiple-twist, hexagonal-mesh, metal netting into partially-fabricated structures adapted to be stored and/or dispatched to the user in a flattened state and assembled into box gabions on the site at which they were to be used.

During this assembly, the diaphragm, which was already located on that part of the panel intended to form the bottom of the gabion, and fixed to that part by the helical seam, was erected and fixed to the side walls of the gabion, and sometimes also to the cover, by seaming carried out by hand with a metal wire.

Given the need to carry out these operations manually, the fixing of the diaphragms to the base-panel during the processing of the panel itself on the production line was excluded completely, thus quickening the operations along this line and also simplifying and reducing the cost of the plant and of operating it, due to the absence of the device for forming the helical seam.

The diaphragm was furnished separately to the user and was positioned relative to the other walls of the gabion and fixed thereto on the site at which the gabion was to be used.

It is well known that this system prolongs the operations needed to put the gabion into use and has to be carried out by skilled workmen, which is obviously reflected in the costs.

The object of the present invention is to provide a process for the articulated connection of at least one diaphragm to that part of the base panel intended to form the bottom of a box gabion, which allows diaphragms to be positioned relative to the said part and to be fixed thereto so as to be articulated to it, without the production line on which the gabion is constructed from a multiple-twist, hexagonal-mesh, metal netting including a device for fixing the diaphragm to the panel by means of a helical seam, or by any other system.

SUMMARY OF THE INVENTION

According to the present invention this object is achieved by a process for the articulated connection of an edge portion of an hexagonal-mesh, wire-netting panel to a further netting panel intended to form the bottom of a gabion, said edge portion comprising a marginal row of meshes of which each adjacent pair has a common side formed by twisting two wires together, free end portions of said two wires diverging each to form a side of a respective one of said pair of meshes, wherein said articulated connection is effected by:

bending each said free end portion of wire back into said respective one of said pair of meshes to form a hook so that each common side of each marginal row of meshes terminates in two said hooks; and inserting said common sides through a row of meshes of said further netting panel and withdrawing said hexagonal-mesh wire-netting panel so as to engage said hooks with the netting of said further panel to form the articulated connection.

BRIEF DESCRIPTION OF THE DRAWINGS

Other characteristics and advantages of the invention will emerge from the description which follows with reference, by way of non-limiting example, to one practical embodiment, illustrated in the appended drawings, in which.

Figure 1:
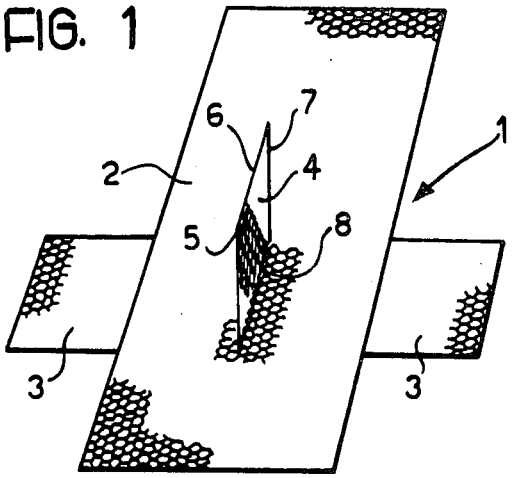
FIG. 1 is a perspective view which shows a partially-fabricated structure which can be assembled to form a box gabion, and which includes a diaphragm fixed by a helical seam to the base panel according to the teaching of the prior art.
Figure 2:
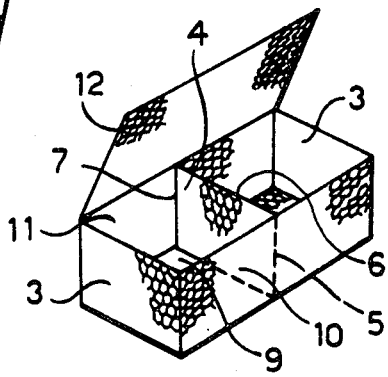
FIG. 2 is a perspective view of the gabion constructed from the partially-fabricated structure illustrated in FIG. 1, before filling with ballast and closure of its lid.
Figure 3:
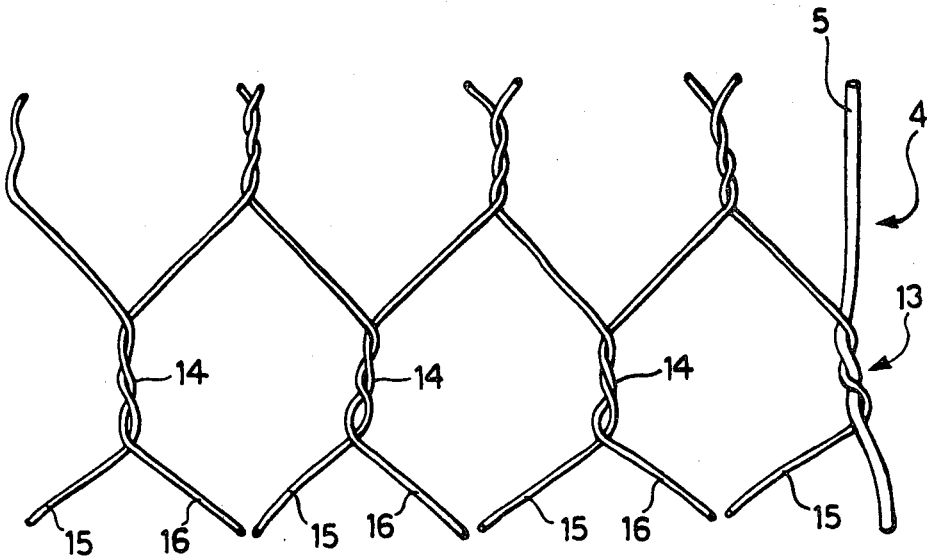
FIG. 3 is a plan view, on an enlarged scale, showing a section of the edge of a diaphragm which is to be articulated to that part of a base panel intended to constitute the bottom of a gabion.

The partially-fabricated structure illustrated in FIG. 1, which can be assembled into a box gabion, is indicated in its entirety by the reference numeral 1, and includes a so-called base panel 2 to the opposite longitudinal edges of which are articulated panels 3 destined to form the shorter sides or lateral walls of the gabion. A diaphragm 4 destined to subdivide the interior of the gabion into two equal cells is articulated to a predetermined zone of that part of the base-panel 2 intended to constitute the bottom of the gabion. This diaphragm 4, which is prefabricated separately to a pre-established extent, is provided with a so-called "selvedge" and reinforcing wires along its sides 5, 6 and 7 intended to be connected to the opposite longitudinal walls and the lid, which are formed by suitable folding of the base panel 2 during erection of the gabion itself. The fourth side of the diaphragm 4 is joined to a row of hexagonal meshes of the base panel 2 by a helical seam 8 which can be formed with the aid of a purpose-made device located in the production line on which the partially-fabricated structure, which can be assembled to make the gabion, is constructed from cut pieces of the multiple-twist hexagonal-mesh metal netting.

During the assembly of the partially-fabricated structure illustrated in FIG. 1, the diaphragm 4 is disposed perpendicular to the bottom 9 of the gabion and its sides 5 and 7 are seamed by hand to the long side walls 10 and 11 respectively, while, after filling of the cells into which the diaphragm 4 subdivides the interior of the gabion and after closure of the lid 12, the upper side 6 is seamed, again by hand with the use of metal wire, to the lid.

According to the invention, the edge of the diaphragm 4 is different from that of the prior art in that it has a marginal row 13 of hexagonal meshes, the common sides 14 of which are formed by double twisting of pairs of wires, divergent lengths 15 and 16 respectively of which form those sides of the hexagons belonging to the row 13 which face outwardly of the edge of the diaphragm.

Figure 4:
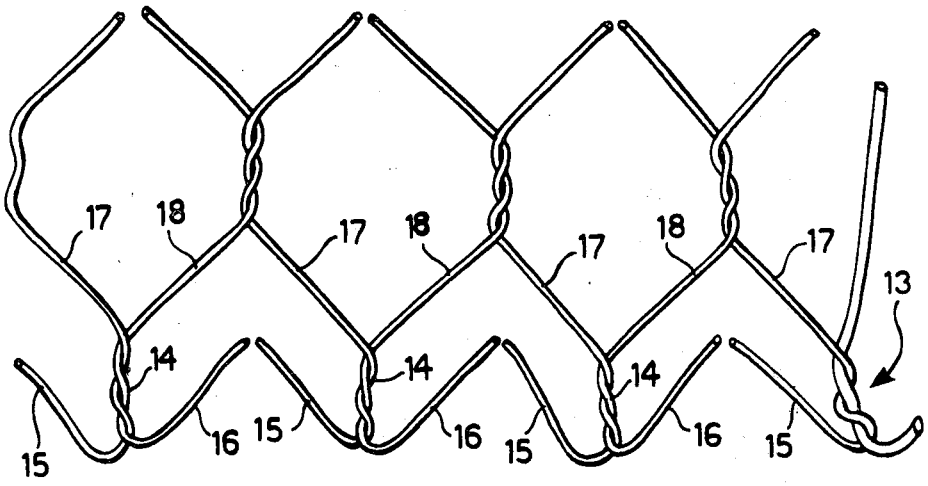
FIG. 4 is a plan view which shows the edge illustrated in FIG. 3 shaped in accordance with a first stage in the process of the invention.

In order to adapt this edge to hook onto the netting of the said part of the base panel, the said lengths 15 and 16 are bent inwardly of the hexagonal meshes of the row 13 so that the common sides 14 of the hexagonal meshes of this row each end with a double-hook structure illustrated in FIG. 4.

In the latter Figure, each length 15 and 16 of the wires from which the hexagonal meshes of the row 13 are made is disposed parallel to a portion 17 or 18 respectively of the identical wire of which the lengths 15 or 16 constitutes the end portion, and which extends from the other end of the common side 14 of two adjacent hexagonal meshes of the row 13 along which the said lengths 15 and 16 are doubly twisted together.

Figure 5:
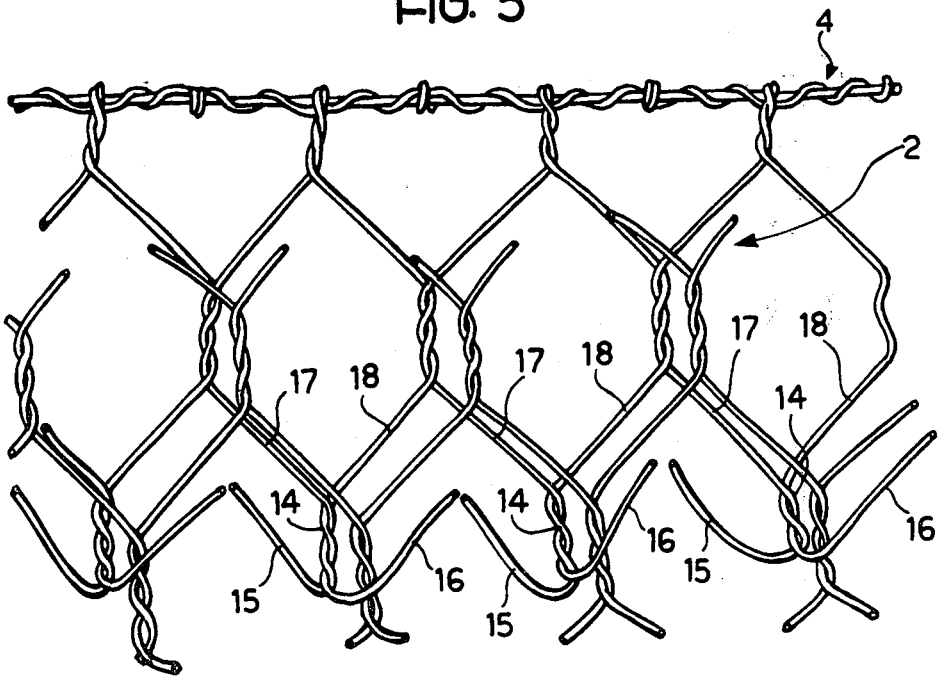
FIG. 5 is a perspective view which shows that edge of the diaphragm shaped as illustrated in FIG. 4 engaged with the hexagonal meshes of the part of the base panel intended to constitute the bottom of a gabion, in accordance with a second stage in the process of the invention.

The structure illustrated in FIG. 4 is ready for articulated connection to a longitudinal row of meshes of the base panel 2 in the manner illustrated in FIG. 5.

For this purpose it suffices to pass the double hooked structures 14, 15 and 16 through the meshes of this longitudinal row of the base panel and after the hooks 15 and 16 have been completely passed through the mesh base panel, the diaphragm panel 4 having hooks 15 and 16 is shifted laterally while simultaneously being withdrawn so that each hook 16 will engage a twisted portion of a row of meshes in the base panel.

What is claimed is:

1. A process for the articulated connection of an edge portion of a hexagonal-mesh, wire-netting panel to a further netting panel intended to form the bottom of a gabion, said edge portion comprising a marginal row of meshes of which each adjacent pair has a common side formed by twisting two wires together, free end portions of said two wires diverging each to form a side of a respective one of said pair of meshes, wherein said articulated connection is effected by:

bending each said free end portion of wire back into said respective one of said pair of meshes to form a hook, so that each common side of said marginal row of meshes terminates in two said hooks; and inserting said common sides through a row of meshes of said further netting panel and laterally shifting and withdrawing said hexagonal-mesh wire-netting panel so as to engage said hooks with the netting of said further panel to form the articulated connection.

2. An articulated connection for pivotally inter-connecting two wire-net panels comprising a first panel having an edge portion defined by a marginal row of meshes wherein each adjacent pair of meshes has a common side formed by twisting two wires together with the free end portion of each of said two wires being bent back into a respective one of said meshes to form a hook and a second panel having a plurality of rows of uniform meshes having twisted connections wherein one hook of each of said two wires of said first panel engages a twisted connection along a row of meshes of said second panel.

3. A box gabion having top, side and bottom panels inter-connected with each other and at least one diaphragm detachably and pivotally connected to said base member wherein said base panel and said diaphragm are each comprised of a wire net fabric, said diaphragm having an edge portion defined by a marginal row of meshes wherein each adjacent pair of meshes has a common side formed by twisting two wires together with the free end portion of each of said two wires being bent back into a respective one of said meshes to form a hook and said bottom panel having a plurality of rows of uniform meshes having twisted connections wherein one hook of each of said two wires of said diaphragm engages a twisted connection along a row of meshes in said bottom panel.

* * * * *